US005320588A

United States Patent [19]

Wanzer et al.

[11] Patent Number: 5,320,588

[45] Date of Patent: Jun. 14, 1994

[54] INDEPENDENT ACTION EXERCISE APPARATUS WITH ADJUSTABLY MOUNTED LINEAR RESISTANCE DEVICES

[75] Inventors: Richard A. Wanzer, Bothell; Cole J. Dalton, Snohomish, both of Wash.

[73] Assignee: Precor Incorporated, Bothell, Wash.

[21] Appl. No.: 918,353

[22] Filed: Jul. 23, 1992

[51] Int. Cl.[5] ..... A63B 23/04

[52] U.S. Cl. ..... 482/53; 482/908

[58] Field of Search ..... 482/51, 52, 53, 79, 482/80, 908

[56] References Cited

U.S. PATENT DOCUMENTS

| | | | |
|---|---|---|---|
| 4,149,715 | 4/1979 | Kusmer | 482/79 |
| 4,183,520 | 1/1980 | Chase . | |
| 4,452,447 | 6/1984 | Lepley et al. . | |
| 4,645,197 | 2/1987 | McFee . | |
| 4,795,147 | 1/1989 | Seal . | |
| 4,838,543 | 6/1989 | Armstrong et al. . | |
| 4,863,161 | 9/1989 | Telle . | |
| 4,909,504 | 3/1990 | Yang . | |
| 4,974,831 | 12/1990 | Dunham . | |
| 5,004,224 | 4/1991 | Wang | 482/53 |
| 5,048,827 | 9/1991 | Caruso . | |

FOREIGN PATENT DOCUMENTS

| | | | |
|---|---|---|---|
| 0277266 | 8/1988 | European Pat. Off. | 482/80 |
| 2243794 | 3/1974 | Fed. Rep. of Germany | 482/52 |

*Primary Examiner*—Stephen R. Crow

*Attorney, Agent, or Firm*—Christensen, O'Connor, Johnson & Kindness

[57] ABSTRACT

An exercise apparatus (10) includes left and right levers (14, 16) mounted on a frame (12) to pivot about a first pivot axis (17). The left and right levers are connected to the first ends of corresponding left and right shock absorbers (18, 20). The second ends of the left and right shock absorbers are pivotally mounted on the frame by a mounting mechanism (22), including a threaded rod (78), for adjustable positioning of the second ends of the shock absorbers relative to the first pivot axis of the levers. The present invention provides for simultaneous adjustment of the resistance offered by the two shock absorbers against rotation of corresponding independent levers.

15 Claims, 3 Drawing Sheets

INDEPENDENT ACTION EXERCISE APPARATUS WITH ADJUSTABLY MOUNTED LINEAR RESISTANCE DEVICES

FIELD OF THE INVENTION

The present invention relates to exercise apparatus, and more particularly to exercise apparatus with reciprocating levers that are operably by an exerciser to simulate climbing motion.

BACKGROUND OF THE INVENTION

Various exercise apparatus have been designed that enable exercisers to work against levers pivotally secured to a frame and coupled to resistance mechanisms. For example, exercise devices may include two levers that are operated by a user's legs while the user is in a standing position to simulate climbing exercise. Other devices may also include hand operable levers to simulate a full body climbing motion, or may include levers for simulation of rowing motion.

Often such exercise apparatus will include left and levers for exercising an exerciser's left and right limbs. The left and right levers are coupled for synchronous motion by a rope and pulley, teeter-totter mechanism, or other linkage. For such "dependent" action systems, often a single resistance device, such as a shock absorber, is coupled to just one of the levers. The lever linkage ensures that motion of the other lever is also resisted by the resistance device. The resistance against which the user must operate when moving either lever is altered by adjusting the single resistance device. Thus, adjustment of the resistance level is fairly simple. However, such dependent apparatus have the drawback of forcing the exerciser to exercise both sides of his or her body to the same extent, due to the linkage of the levers. Both levers must move through an equal range of motion, i.e., the levers are constrained to reciprocate in synchronous fashion. While desirable for some exercisers, other exercisers may prefer greater flexibility in tailoring the resistance against which the muscles of opposite limbs must work.

Other apparatus include left and right levers that are not linked together, and which are each coupled to separate corresponding resistance mechanisms. These "independent" action exercise devices enable each resistance mechanism to be separately adjusted. Such independent action exercisers also overcome another limitation of dependent exercisers by permitting the exerciser to operate opposing levers nonsynchronously. For example, an exerciser on an independent action climbing device may take a larger stride with one side of his or her body relative to the other side. This nonsynchronous motion is accommodated by the independent and separate resistance mechanisms. However, a drawback of these independent systems is that each resistance mechanism must be separately adjusted, making adjustment of the resistance level more time consuming. Further, those exercisers desiring to work each limb against the same level of resistance must ensure that both resistance mechanisms are adjusted to the same extent.

SUMMARY OF THE INVENTION

The present invention provides an adjustable resistance exercise apparatus that includes: a frame; at least a first lever pivotally connected to the frame to pivot about a first pivot axis; a first linear resistance device having a first end pivotally connected to the first lever at a location spaced from the first pivot axis; and a mounting mechanism for pivotally mounting a second end of the first linear resistance device to the frame and for adjustably positioning the second end of the first linear resistance device relative to the first pivot axis.

In a further aspect of the present invention, an adjustable resistance exercise apparatus is disclosed that includes: a frame; first and second levers pivotally mounted on the frame to pivot about a first pivot axis for independent reciprocal motion; a first linear resistance device having a first end pivotally secured to the first lever at a location spaced from the first pivot axis; a second linear resistance device having a first end pivotally secured to the second lever at a location spaced from the first pivot axis; and a mounting mechanism for pivotally mounting the second ends of both the first and second linear resistance devices to the frame at selected distances relative to the first pivot axis to provide for simultaneous adjustment of the resistance provided by the first and second linear resistance devices.

In a preferred embodiment, the second ends of the first and second linear resistance devices are coupled to a transverse shaft threadably engaged to one end of a threaded rod, with the other end of the threaded rod being coupled to the frame. Rotation of the threaded rod results in a change in position of the transverse shaft relative to the first pivot axis, thereby adjusting the proportional change in length of each of the linear resistance devices in relation to the extent of pivotal motion of the respective levers.

The exercise apparatus of the present invention thus has a benefit of independent action devices, in that each lever may be separately and nonsynchronously operated, and is resisted by a corresponding separate linear resistance device. However, one of the benefits of dependent action devices is also obtained in that both of the separate linear resistance devices may be simultaneously adjusted simply and quickly. Further, a single adjustment of the mounting mechanism ensures that both linear resistance device are adjusted to the same extent, thereby providing that a user's left and right limbs each operate against the same level of resistance.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
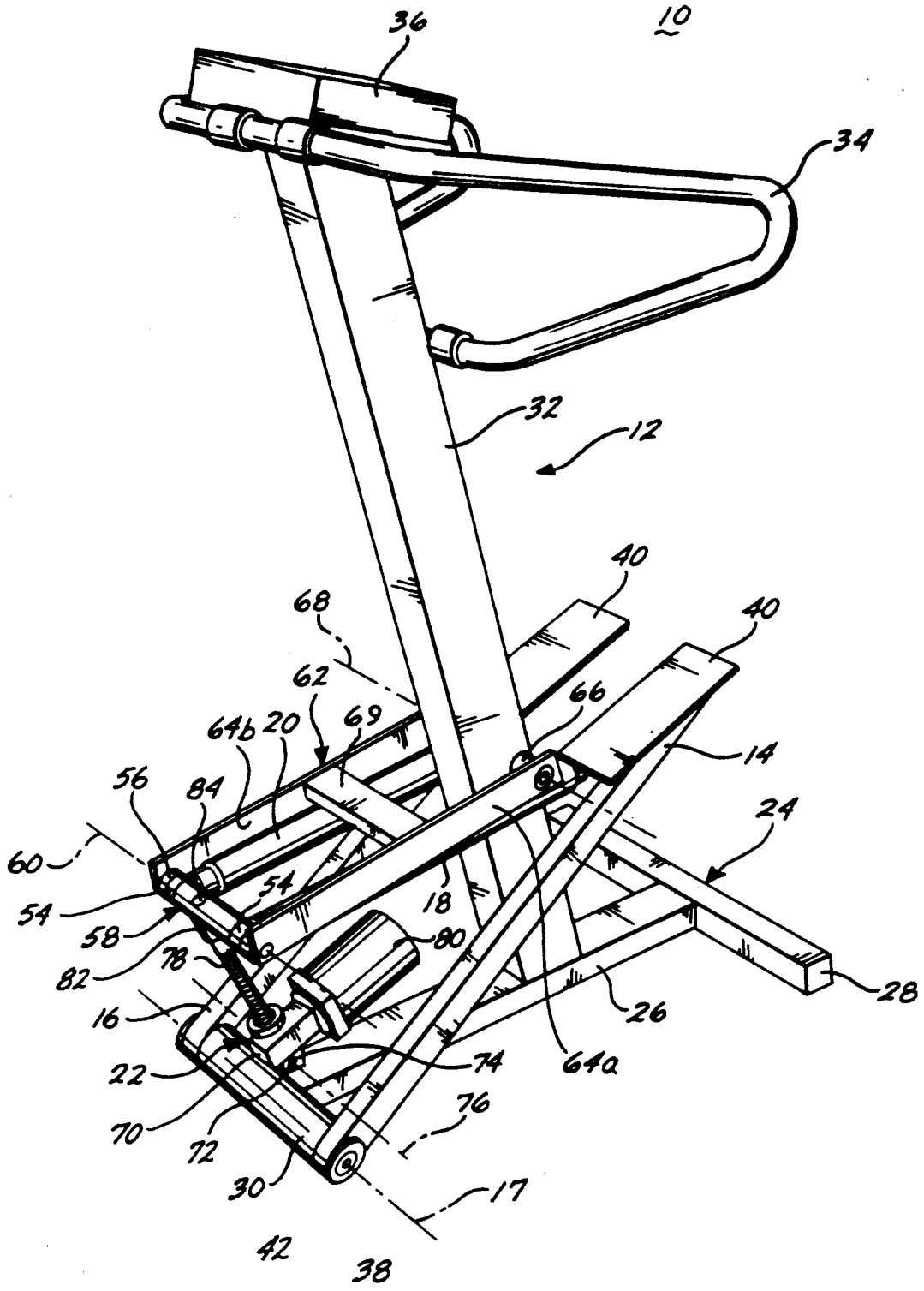
FIG. 1 provides a pictorial view of an exercise apparatus constructed in accordance with the present invention, with the mounting mechanism adjusted so that the distal ends of the linear resistance devices are at a maximum elevation, thereby providing the highest level of resistance.
Figure 2:
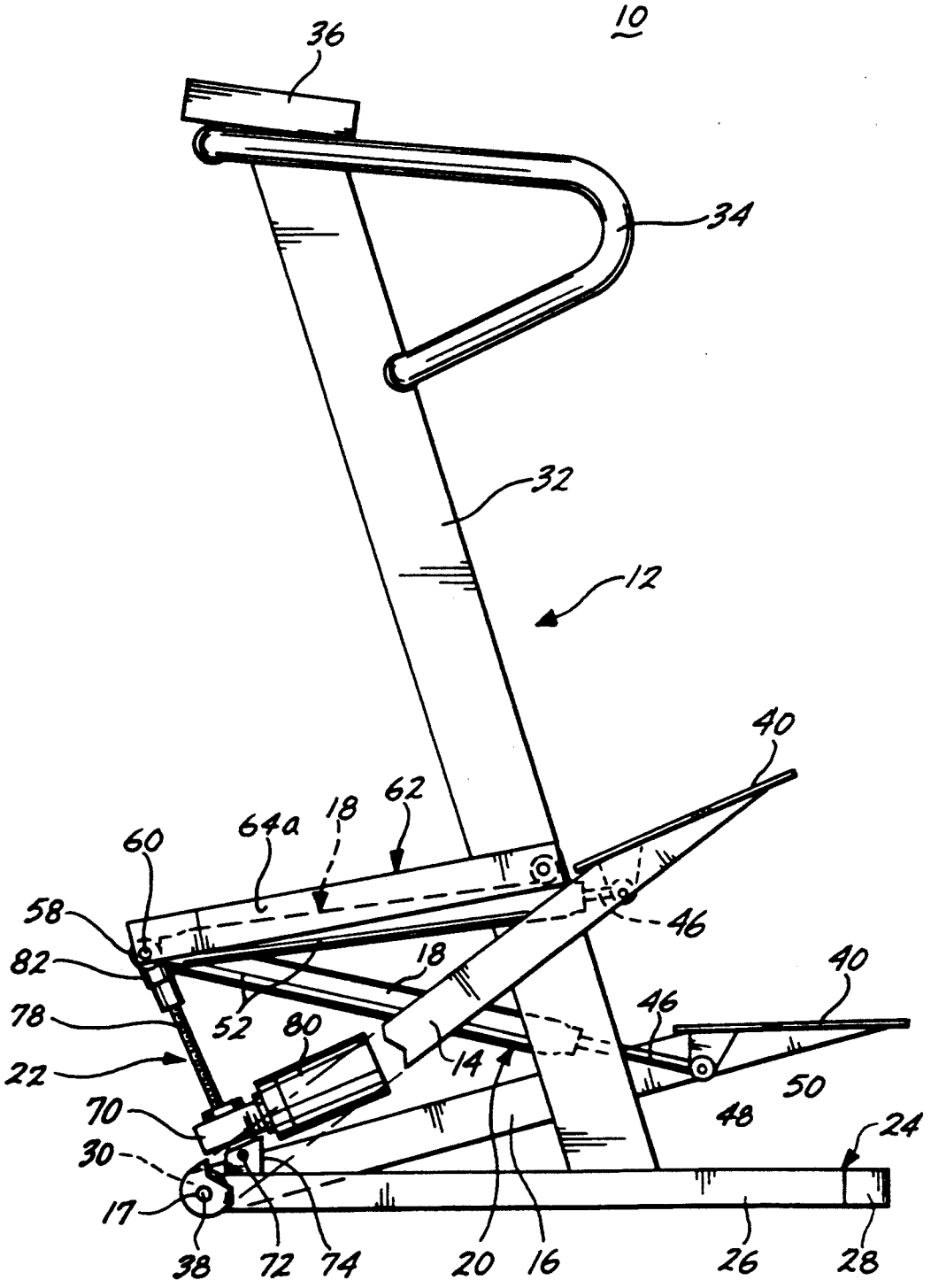
FIG. 2 is a side elevation view of the exercise apparatus of FIG. 1 with the mounting mechanism at the maximum elevation, and a portion of the left lever shown broken away for clarity.
Figure 3:
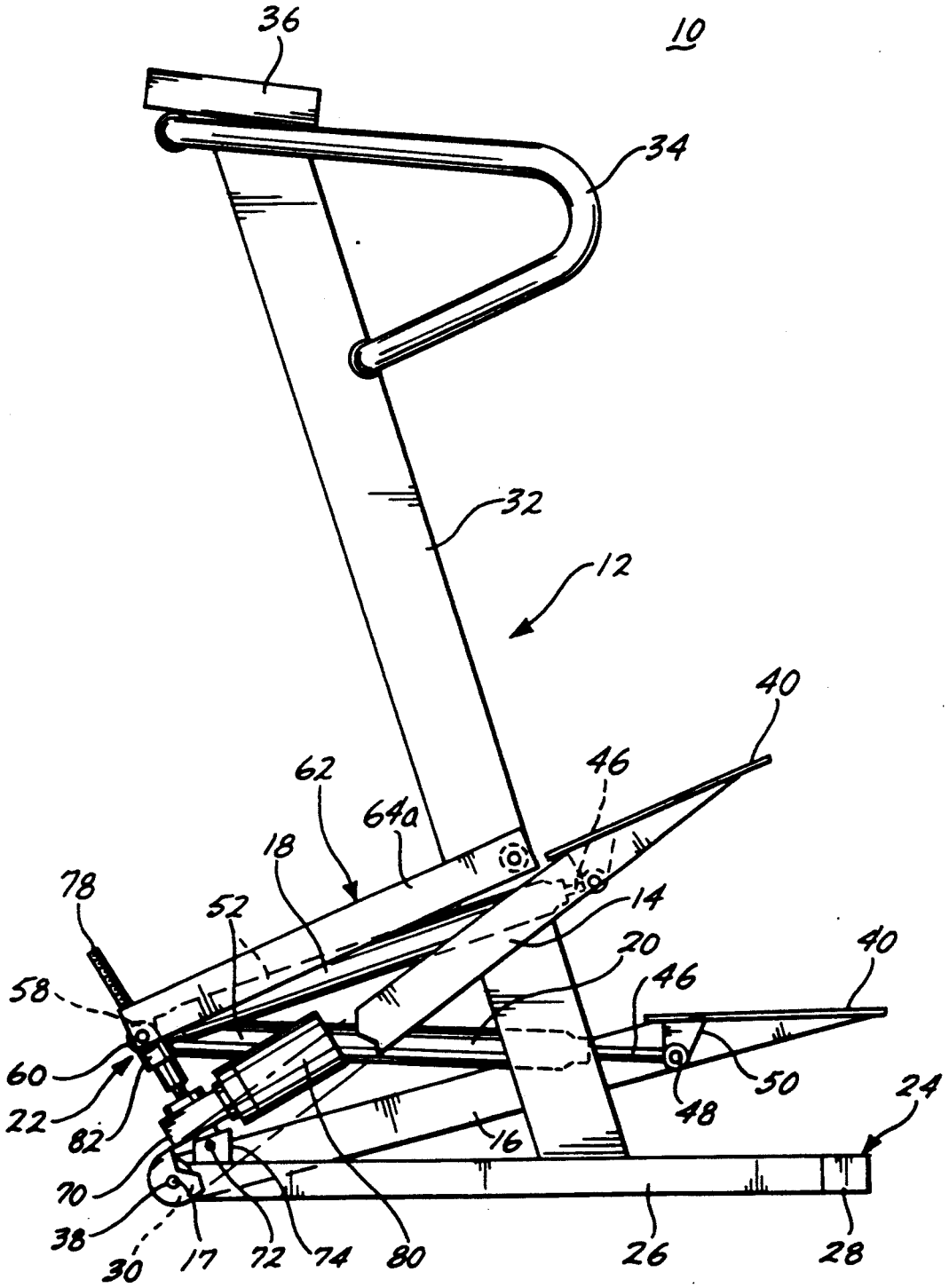
FIG. 3 is a side elevation view of the exercise apparatus of FIG. 1, but with the distal ends of the linear resistance devices adjusted to near the lowest elevation, thereby providing near the lowest level of resistance, and with a portion of the left lever shown broken away for clarity.

A preferred embodiment of an exercise apparatus 10 constructed in accordance with the present invention is shown in FIGS. 1 through 3. The exercise apparatus 10 includes a frame 12 on which are mounted left and right reciprocating levers 14 and 16, respectively, to pivot about a first pivot axis 17. The apparatus 10 further includes left and right shock absorbers 18 and 20, respectively, which have a proximal end connected to the corresponding left and right levers 14 and 16, and a distal end coupled by a mounting mechanism 22 to the frame. The mounting mechanism 22 enables adjustable positioning of the distal ends of the shock absorbers 18 and 20 relative to the first pivot axis 17 of the left and right levers 14 and 16.

Referring to FIG. 1, the frame 12 includes a ground engaging base 24 including an elongate, longitudinal base member 26. The base 24 further includes a rearward transverse base member 28 secured across one end of the central base member 26, and a forward transverse base shaft 30 secured across the opposite end of the central base member 26. As used herein throughout, forward refers to the direction in which an exerciser faces during normal use of the apparatus 10, while rearward refers to the opposite direction. The frame 12 further includes an upright frame member 32 projecting upwardly from the central base member 26 from a point located between the rearward transverse member 28 and forward transverse shaft 30. The upright frame member 32 is preferably angled slightly forwardly.

A formed handlebar 34 is secured proximate to the upper end of the upright frame member 32, and projects laterally outward and rearwardly on either side of the upright member 32. An electronic console 36 is secured to the upper end of the upright frame member 32.

It should be readily apparent to those of skill in the art that alternate frame constructions could be used in place of that described herein, and still be within the scop of the present invention. For example, two parallel paced upright members (not shown) could be used in place of the single upright member 32. Further, the illustrated angling of the upright members and contour of the handlbars could be changed. Thus, the handlbars could extend fully to the base of the frame, for example.

The left and right levers 14 and 16 are mounted on opposite ends of the forward transverse shaft 30 by studs 38. The levers 14 and 16 pivot in a reciprocal manner about the first pivot axis 17, which is substantially aligned with the longitudinal axis of the forward transverse shaft 30. The levers 14 and 16 each are pivotable between an upper, nominal position, in which the left lever 14 is shown in FIG. 2, and a lower, displaced position, in which the right lever 16 is shown in FIG. 2. Foot platforms 40 are secured to the upper surface of the rearward ends of each of the left and right levers 14 and 16. Alternately, the platforms 40 and corresponding levers 14 and 16 could be integrally formed, having a one-piece construction.

During normal use of the apparatus, an exerciser stands with his or her left or right feet on the foot platforms 40 of the left and right levers 14 and 16, respectively. The exerciser grips the handlebar 34, while alternately depressing the left and right levers 14 and 16 in reciprocal fashion. The apparatus 10 also includes a biasing mechanism for urging each of the levers from the lower displaced position to the upper displaced position. In the preferred embodiment of the apparatus 10 shown in FIG. 1, elastomeric torsion springs 38 are mounted between the levers 14 and 16 and respective studs 38. The construction and mounting of the elastomeric torsion springs is more fully described in U.S. patent application Ser. No. 559,633, filed Jul. 30, 1990, the disclosure of which is hereby incorporated by reference. Other conventional return mechanisms can be used in place of the torsion springs 38, such as coil springs.

Reciprocation of the levers 14 and 16 is resisted by linear resistance devices, such as the shock absorbers 18 and 20, which provide substantially linear resistance proportional to the extent of elongation of the shock absorbers. It will be apparent to those of skill in the art that other linear resistance devices, such as coil extension springs, gas springs, or compression springs mounted between the foot platforms 40 and the base of the frame, for example, can be used in place of the shock absorbers.

The shock absorbers 18 and 20 are each mounted in identical fashion, thus only the mounting of the right shock absorber 20 will be described in detail. The shock absorber 20 includes a proximal, rod end 46 that is pivotally secured by a pin 48 to an ear 50 (FIG. 2) projecting downwardly from the inward underside surface of the corresponding foot platform 40, thereby connecting the shock absorber to the lever 16. It should be apparent that one end of the shock could be secured at other locations along the corresponding levers 14 and 16, such as close to the first pivot axis 17. The distal, cylinder end 52 of the shock absorber 20 terminates in an eye 54 that is pivotally secured on a bearing 56 to the right end of a transverse mounting shaft 58 (FIG. 1).

The left shock absorber 18 is similarly connected to the left lever 14 and to the opposite end of the transverse mounting shaft 58. The distal ends 52 of the shock absorbers 18 and 20 are pivotable about a shock absorber pivot axis 60, substantially aligned with the longitudinal axis of the transverse mounting shaft 58. The distal ends 52 of the shock absorbers 18 and 20 are spaced apart on the transverse mounting shaft 58 by a distance substantially equal to the spacing of the ears 50 on the underside of the left and right foot platforms 40.

The transverse mounting shaft 58 is longitudinally supported above the base 24 by a swing arm assembly 62. The shock absorber pivot axis 60 of the transverse mounting shaft 58 is disposed parallel to a plane defined by the base 24 and perpendicular to the longitudinal axis of the central base member 26. Referring to FIG. 1, the swing arm assembly 62 includes left and right swing arms 64*a* and 64*b*, respectively. The rearward, proximal ends of the swing arms 64*a* and 64*b* are pivotally secured to the laterally projecting ends of a transverse through shaft 66 secured within an aperture (not shown) formed crosswise through the upright frame member 32 at a location spaced above the base 24. The swing arms 64*a* and 64*b* are thus able to pivot about a swing arm axis 68 that is substantially aligned with the longitudinal axis of the transverse through shaft 66.

The forward, distal ends of the swing arms 64*a* and 64*b* are pivotally secured to the corresponding ends of the transverse mounting shaft 58, and are thereby coupled to the distal ends 52 of the shock absorbers 18 and 20, respectively. The swing arm assembly 62 maintains the shock absorber pivot axis 60 a fixed distance from the swing arm axis 68. As shown in FIG. 1, the swing arms 64*a* and 64*b* are disposed parallel to each other, on the outer sides of the corresponding shock absorbers 18 and 20. A cross brace 69 is secured transversely between the swing arms 64a and 64b at a location between the swing arms' proximal and distal ends.

The mounting mechanism 22 provides vertical support for the transverse mounting shaft 58, and thus, the distal ends of the shock absorbers 18 and 20 and the swing arm assembly 62. The mounting mechanism 22 includes a lower coupler 70 pivotally secured by a pin 72 between upwardly projecting base flanges 74 projecting upwardly from the central base member 26 proximate the forward transverse base shaft 30. The lower coupler 70 is thus able to pivot about a lower axis 76 relative to the base 26 (FIG. 1). The lower coupler 70 rotatably receives the lower end of a threaded rod 78. The lower end of the threaded rod 78 is engaged by conventional gearing (not shown), such as beveled gearing, to the drive shaft (not shown) of a motor 80 secured to the rearward side of the lower coupler 70. The threaded rod 78, lower coupler 70 and motor 80 thus pivot as an assembly about the lower axis 76.

The upper end of the threaded rod 78 is received within a threaded central aperture (not shown) of an upper coupler 82 that is secured radially to the transverse mounting shaft 58 at a point midway between the shaft's ends. The threaded central aperture of the upper coupler 82 is aligned with a cross passage 84 formed through the transverse mounting shaft 58. Operation of the motor 80 drives rotation of the threaded rod 78. As the threaded rod 78 rotates, the upper coupler 82 moves upwardly or downwardly along the length of the threaded rod 78, thereby raising and lowering the transverse mounting shaft 58. Operation of the motor 80, and thus adjustment of the vertical position of the transverse mounting shaft 58, is preferably controlled by a microprocessor and related circuitry (not shown) housed within the electronic console 36. However, it should be apparent to those of skill in the art that an apparatus could be constructed with a manually rotatable shaft 78, rather than for automated adjustment.

Operation of the mounting mechanism 22 to simultaneously adjust the resistance provided against pivoting of each of the levers 14 and 16 shall now be described with reference to FIGS. 2 and 3. When the threaded rod 78 has been rotated so as to advance the upper coupler 82 to the uppermost position on the rod 78, as shown in FIG. 2, the resistance provided by the shock absorbers 18 and 20 is maximized. In this position, the distal ends 52 of the shock absorbers 18 and 20 are raised to their highest elevation relative to the first pivot axis 17 of the levers 14 and 16. This results in a maximum change in length of the shock absorbers 18 and 20 relative to a given pivotal displacement of the levers 14 and 16, respectively, from the nominal upper position to the lower displaced position. In other words, the ratio of the change in length of the shock absorber 18 or 20 over the pivotal displacement of the corresponding levers 14 or 16 is maximized. Further, when the upper coupler 82 is at or near its highest elevation, less of the force exerted by an exerciser against the foot pedal 40 is aligned with the longitudinal axis of the shock absorber 18 or 20.

When the threaded rod 78 is operated to lower the transverse mounting shaft 58 (FIG. 3), and thus also lower the distal ends of the shock absorbers 18 and 20 and the swing arm assembly 62, the resistance provided by the shock absorbers 18 and 20 is reduced. As the transverse mounting shaft 58 is lowered closer to the first pivot axis 17 of the levers 14 and 16, the extent of change in length of the shock absorbers 18 or 20 relative to the pivotal motion of the corresponding lever 14 or 16 from the upper nominal position to the lower displaced position is reduced. Correspondingly, the leverage of the levers 14 and 16 utilized by the exerciser to elongate the shock absorbers 18 and 20, respectively, is increased. The elevation of the transverse mounting shaft 58 relative to the first pivot axis 17 and base 24 can thus be adjusted, through operation of the motor 80, to increase or decrease the resistance provided against pivotal motion of the levers 14 and 16.

One of the benefits of the present invention is that although the shock absorbers 18 and 20 act completely independently, their positioning relative to the base 26 is adjusted simultaneously by operation of the mounting mechanism 22. The levers 14 and 16 can be moved independently of each other, in a nonsynchronous fashion if desired, with the resistance offered by each being proportional to the change in length of the corresponding shock absorber 18 or 20 caused by depression of the lever.

Although the independent action apparatus 10 described above is preferred, it should be apparent to those of skill in the art that the present invention can be adapted for dependent action of the levers by providing a linkage mechanism between the levers 14 and 16, such as by including a rope and pulley linkage or teeter-totter type mechanism, as is well known in the art. In such case, one lever is constrained to move to the upper, nominal position as the other lever is displaced to the lower position. A single resistance mechanism, such as a single shock absorber coupled to one of the levers, could thus be used to provide resistance to movement of both levers. In this situation, the elevational positioning of the forward end of the shock absorber would be adjusted by use of the mounting mechanism 22 discussed above, adapted for connection to only one shock absorber.

Further, it should be apparent to those of skill in the art, based on the disclosure herein, that other mechanisms in place of the threaded rod 78 could be used to adjustably elevate the distal ends of the linear resistance devices (e.g., shock absorbers 18, 20) above the first pivot axis 17. For example, an adjustable gas spring, a rack and pinion mechanism, or a hydraulic or mechanical jack could be used, all within the scope of the present invention.

The present invention has been described above in terms of a preferred embodiment and variations thereof. It will be apparent to those of ordinary skill in the art that various alterations, modifications, and substitutions can be made to the present invention without departing from the scope thereof. For example, the present invention can be adapted to provide for adjustment of the resistance to other reciprocating members of an exercise apparatus, such as to resist movement of hand levers on a rowing machine or exercise cycle. Thus it is intended that the scope of protection granted by letters patent hereon be limited only by the definitions contained in the appended claims, and not by the specific embodiments described herein.

The embodiments of the invention in which an exclusive property or privilege is claimed are defined as follows:

1. An adjustable resistance exercise apparatus, comprising:

(a) a frame;

(b) first and second levers pivotally connected to the frame to pivot about a first pivot axis;

(c) linear resistance means having a first end pivotally connected to at least one of the first and second levers at a location spaced from the first pivot axis; and (d) mounting means for pivotally mounting a second end of the linear resistance means to the frame and for adjustably positioning the second end of the linear resistance means relative to the first pivot axis to change the level of resistance applied to the connected one of the first and second levers by the linear resistance means, wherein the mounting means comprises:

an elongate threaded rod;

a first coupler rotatably coupled to a first end of the threaded rod and pivotally connected to one of the frame and the second end of the linear resistance means; and a second coupler threadably engaged with a second end of the threaded rod and pivotally connected to the other of the frame and the second end of the linear resistance means, wherein rotation of the threaded rod results in adjustment of the distance separating the first and second couplers.

2. The exercise apparatus of claim 1, wherein the first coupler is pivotally coupled to the frame and the second coupler is pivotally coupled to the second end of the linear resistance means.

3. The exercise apparatus of claim 2, wherein the second coupler is disposed at an elevation above the first coupler, and rotation of the threaded rod results in a change in elevation of a second end of the linear resistance means relative to the first pivot axis of the first lever.

4. The exercise apparatus of claim 3, wherein the frame includes an upright member, further comprising at least one elongate swing arm having a proximal end pivotally connected to the upright member and a distal end pivotally connected to the second coupler.

5. The exercise apparatus of claim 2 wherein the linear resistance means comprises a shock absorber.

6. The exercise apparatus of claim 1, further comprising control means for automatically rotating the threaded rod a desired extent to adjust the resistance provided by the linear resistance means.

7. An adjustable resistance exercise apparatus, comprising:

(a) a frame;

(b) first and second levers pivotally connected to the frame to pivot about a first pivot axis;

(c) linear resistance means having a first end pivotally connected to at least one of the first and second levers at a location spaced from the first pivot axis;

(d) mounting means for pivotally mounting a second end of the linear resistance means to the frame and for adjustably positioning the second end of the linear resistance means relative to the first pivot axis to change the level of resistance applied to the connected one of the first and second levers by the linear resistance means; and at least one elongate swing arm having a proximal end pivotally coupled to the frame and a distal end pivotally coupled to the second end of the linear resistance means.

8. The exercise apparatus of claim 7, wherein adjustment of the mounting means results in a change in elevation of the second end of the linear resistance means relative to the first pivot axis.

9. An adjustable resistance exercise apparatus, comprising:

(a) a frame;

(b) first and second levers pivotally connected to the frame to pivot about a first pivot axis;

(c) first and second linear resistance means each having a first end pivotally connected to a corresponding one of the first and second levers at a location spaced from the first pivot axis;

(d) mounting means for pivotally mounting a second end of both the first and second linear resistance means to the frame and for adjustably positioning the second end of both the first and second linear resistance means relative to the first pivot axis to change the level of resistance applied to the first and second lever by the first and second linear resistance means; and a transverse mounting shaft coupling the second ends of both the first and second linear resistance means to the mounting means.

10. The exercise apparatus of claim 9, wherein the mounting means comprises an elongate threaded rod having a first end threadably engaged with the transverse mounting shaft and a second end coupled to the frame to enable pivoting of the threaded rod relative to the frame and rotation of the threaded rod.

11. The exercise apparatus of claim 10, wherein the frame includes an upright member, further comprising a swing arm assembly including first and second elongate members, each of the first and second elongate members having a proximal end pivotally secured to the upright frame member and a distal end pivotally secured to the transverse mounting shaft.

12. An adjustable resistance exercise apparatus, comprising:

(a) a frame;

(b) at least a first lever pivotally connected to the frame to pivot about a first pivot axis;

(c) first linear resistance means having a first end pivotally secured to the first lever at a location spaced from the first pivot axis, whereby pivotal motion of the first lever results in a change in the length of the first linear resistance means;

(d) mounting means for mounting a second end of the first linear resistance means to the frame and for enabling selective adjustment of the extent of change in length of the first linear resistance means relative to the extent of pivotal motion of the first lever;

(e) a second lever pivotally connected to the frame to pivot about the first pivot axis; and (f) second linear resistance means having a first end pivotally secured to the second lever at a location spaced from the first pivot axis, wherein the mounting means mounts the second ends of both the first and second linear resistance means to the frame and enables simultaneous selective adjustment of the extent of change in length of both the first and second linear resistance means relative to the extent of pivotal motion of the first and second levers.

13. The exercise apparatus of claim 12, wherein the mounting means comprises:

an elongate threaded rod;

a first coupler mounting a first end of the threaded rod to the frame to enable the threaded rod to pivot relative to the frame and to rotate within the first coupler; and a second coupler threadably engaged with a second end of the threaded rod and pivotally coupled to the second ends of both the first and second linear resistance means.

14. The exercise apparatus of claim 13, further comprising a swing arm assembly having a first end pivotally coupled to the frame and a second end pivotally coupled to the second coupler.

15. An adjustable resistance exercise apparatus, comprising:

(a) a frame;

(b) first and second levers pivotally connected to the frame to pivot about a first pivot axis for independent reciprocal motion;

(c) first linear resistance means having a first end pivotally secured to the first lever at a location spaced from the first pivot axis;

(d) second linear resistance means having a first end pivotally secured to the second lever at a location spaced from the first pivot axis; and (e) mounting means for pivotally mounting the second ends of both the first and second linear resistance means to the frame at a selected distance relative to the first pivot axis for simultaneous adjustment of the resistance provided by the first and second linear resistance means.

* * * * *